US007374049B2

(12) United States Patent
Douglas et al.

(10) Patent No.: US 7,374,049 B2
(45) Date of Patent: May 20, 2008

(54) SCREENING PLANT

(75) Inventors: Paul Douglas, Swadlincote (GB); Patrick Mcenhill, Swadlincote (GB)

(73) Assignee: Extec Screens & Crushers Limited, Derbyshire (GB)

( * ) Notice: Subject to any disclaimer, the term of this patent is extended or adjusted under 35 U.S.C. 154(b) by 516 days.

(21) Appl. No.: 10/504,215

(22) PCT Filed: Feb. 5, 2003

(86) PCT No.: PCT/GB03/00466

§ 371 (c)(1),
(2), (4) Date: Feb. 8, 2005

(87) PCT Pub. No.: WO03/068419

PCT Pub. Date: Aug. 21, 2003

(65) Prior Publication Data

US 2005/0139524 A1 Jun. 30, 2005

(30) Foreign Application Priority Data

Feb. 12, 2002 (GB) ..... 0203241.5
Mar. 13, 2002 (GB) ..... 0205881.6

(51) Int. Cl.
*B07B 1/18* (2006.01)

(52) U.S. Cl. ..... 209/284; 209/285; 209/421

(58) Field of Classification Search ..... 209/284, 209/285, 288, 289, 311, 421
See application file for complete search history.

(56) References Cited

U.S. PATENT DOCUMENTS 1,966,589 A * 7/1934 Lewis ..... 209/289
2,366,222 A * 1/1945 Tocci-Guilbert ..... 209/44
2,458,887 A 1/1949 Winters
2,683,532 A 7/1954 Patten
3,672,505 A 6/1972 Feterl
5,581,916 A * 12/1996 Hirose et al. ..... 37/444
5,957,302 A 9/1999 Douglas
6,843,376 B2 * 1/2005 Dube et al. ..... 209/421
2006/0070925 A1 * 4/2006 Douglas et al. ..... 209/309

FOREIGN PATENT DOCUMENTS

| | | |
|---|---|---|
| EP | 284643 | 10/1988 |
| WO | WO 92/06250 | 4/1992 |
| WO | WO 97/37777 | 10/1997 |

* cited by examiner

*Primary Examiner*—Joseph C Rodriguez
(74) *Attorney, Agent, or Firm*—Kirton & McConkie; Evan R. Witt

(57) ABSTRACT

A screening plant having a main frame, a trammel drum mounted on the main frame to be rotatable about a rotational axis at a small angle to the horizontal, and having an input end and an opposite discharge end at a lower end than the input end, screening apertures provided in the wall of the drum, drive means coupled with the drum and operative to rotate the drum while screening takes place, an input hopper mounted on the main frame and arranged to supply bulk material to the input end of the drum, an inclined guide shoot which feeds material from the hopper laterally so as to enter the input end of the drum, and a cantilever type rotatable mounting assembly which rotatably mounts the input end of the drum on the main frame of the plant.

17 Claims, 12 Drawing Sheets

SCREENING PLANT

BACKGROUND OF THE INVENTION

This invention relates to a screening plant for use in screening a bulk supply of raw material into at least one size range of screened material.

Screening plants are used typically in quarry environments, in order to separate crushed stone into different size ranges of screened material e.g. ballast, gravel, sand, and can be large scale semi-permanent installations. If a smaller scale screening operation is required, then a screening plant may be designed to be readily transportable e.g. on a low loader, or by being self-propelled, so as to be moved from one position to another on site, or from one site to another. Screening plants are also used in site clearance work, in which case the raw material supplied may be soil, clods, tree roots, broken bricks and concrete rubble.

There are many different types of screening plant available, and usually specifically designed for particular tasks. One existing design is known as a "trommel drum", which is a rotating screening drum which has its axis of rotation extending nearly horizontally, although in fact extending gently downwardly from its upper loading end (through which the bulk material is supplied to the drum) to its lower discharge end from which material is discharged. The drum has screening apertures provided in the wall of the drum, through which screened material can pass. A trommel drum is a robust construction which is not expensive, is mechanically simple and therefore reliable, and is often chosen for particular situations.

BRIEF SUMMARY OF THE INVENTION

The invention is concerned with a novel installation of a trommel drum in a screening plant, having improved means for delivering a bulk supply of raw material to the input end of the drum.

A screening plant according to the invention therefore comprises:

a main frame;

a trommel drum mounted on the main frame to be rotatable about a rotational axis at a small angle to the horizontal, said drum having an input end for receiving a bulk supply of raw material and an opposite discharge end, at a lower end than the input end;

screening apertures provided in the wall of the drum; and, drive means coupled with the drum and operative to rotate the drum while screening takes place;

characterised in that an input hopper is mounted on the main frame and is arranged to supply bulk material to the input end of the drum, said hopper comprising:

an upper receiving mouth; and an inclined guide chute arranged below the mouth to receive the bulk material and to guide the material laterally so as to enter the input end of the drum.

The input hopper may also include a pre-screening device to exclude material of excessive size, one example being a bar grizzly screen to remove tree roots and branches from site clearance material.

In a convenient arrangement, the main frame is rotatably mounted on a chassis of a pair of endless tracks via a slew ring, so as to provide an easily manoeuvred screening plant, and in which the discharge of material from the drum can be easily adjusted to suit requirements on site.

To provide balance to the off-set mass of the drum relative to the slewing axis, it is preferred that the engine and related components which provide power, to drive and propel the plant, is mounted on the main frame on the opposite side of the slewing axis to the drum.

As an alternative to a single drum type screening plant, a tandem arrangement of drums may be mounted on the main frame, each having an inboard input end arranged to receive bulk material from a respective inclined guide chute in the input hopper (and such inboard end facing the adjacent inboard end of the other conveyor), and an outboard discharge end.

The tandem arrangement of drums may be provided in a static type of screening plant. Alternatively, if a self-propelled screening plant is required, the main frame plus the tandem arrangement of drums may again be mounted via a slew ring on a chassis of a pair of endless tracks.

Preferred embodiments of the invention will now be described in detail, by way of example only, with reference to the accompanying drawings, in which:

DETAILED DESCRIPTION OF THE INVENTION

Figure 1:
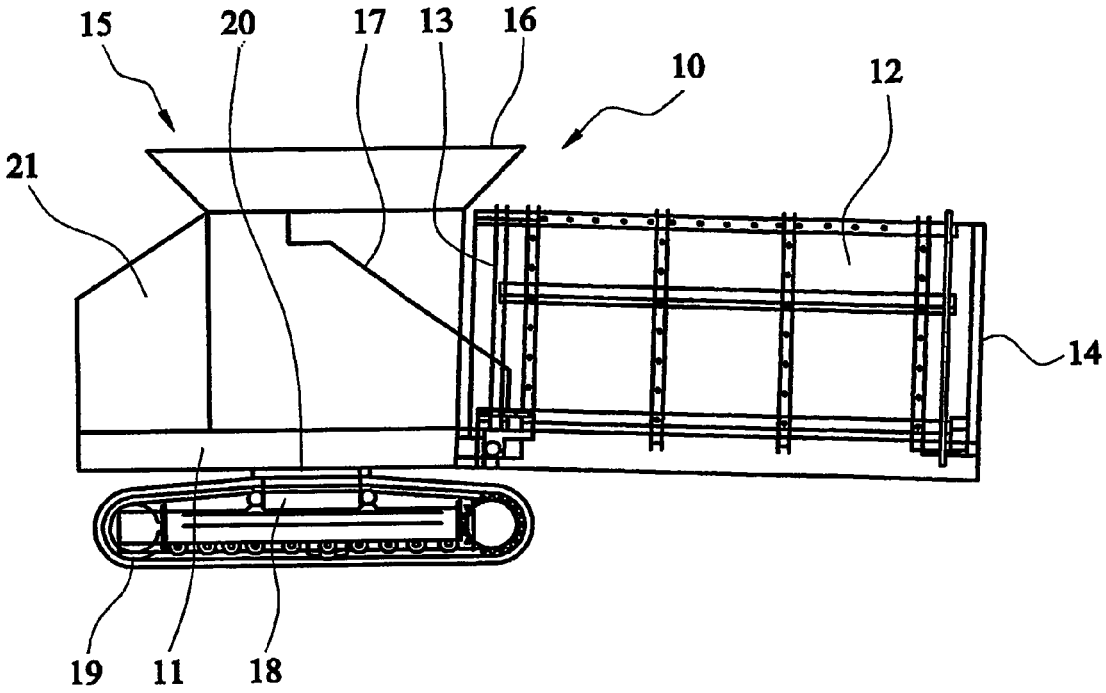
FIG. 1 is a side view of a first embodiment of the invention, and in the form of a single trommel drum type of self propelled screening plant.
Figure 2:
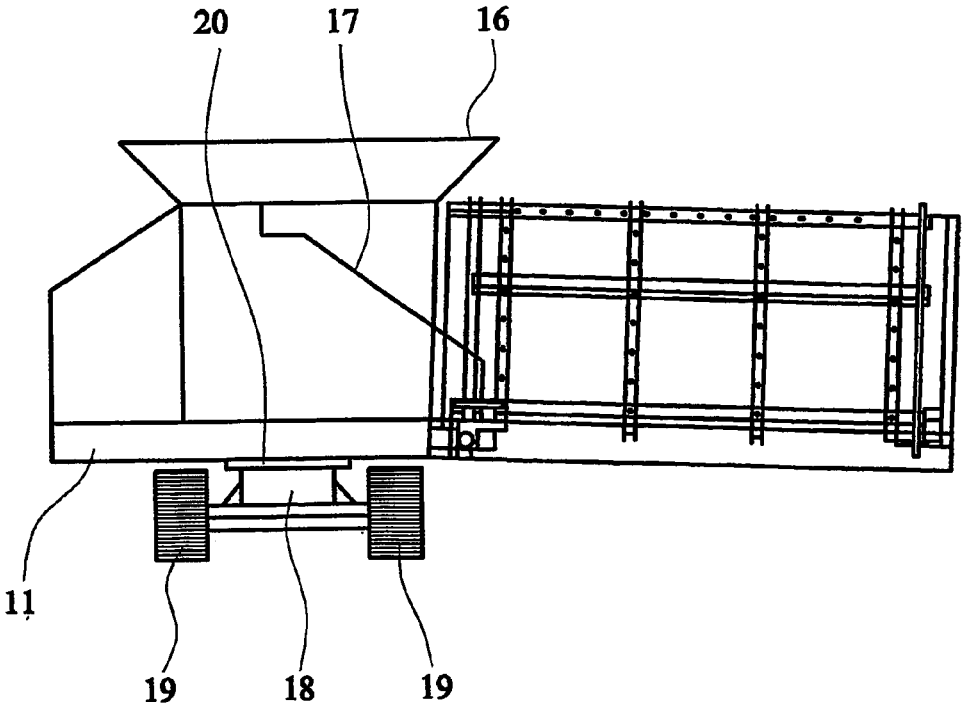
FIG. 2 is a rear view of the plant of FIG. 1, but after rotational adjustment of the drum through 90° to a laterally extending discharge position.

Referring first to FIGS. 1 and 2 of the drawings, an embodiment of screening plant according to the first aspect of the invention is designated generally by reference 10, and comprises a main frame 11 on which a single trommel drum 12 is mounted in cantilever manner so as to be rotatable about a rotational axis extending at a small angle to the horizontal, and with the drum 12 having an input end 13 for receiving a bulk supply of raw material and an opposite discharge end 14, at a lower level than the input end 13.

Screening apertures (not shown in detail) are also provided in the wall of the drum. Also, drive means (not shown in detail) is coupled with the drum 12 and operative to rotate the drum while screening takes place. The drive means, and necessary cantilever type support for the drum includes a near-vertical slew ring secured to the input end 13 of the drum 12, and held captive in a freely rotatable manner in a rigid mounting assembly provided on the chassis (not shown in detail).

An input hopper 15 is mounted on the main frame 11 and is arranged to supply bulk material to the input end 13 of the drum 12. The hopper 15 comprises an upper receiving mouth 16, and an inclined guide chute 17 which is arranged below the mouth 16 to receive the bulk material and to guide the material laterally so as to enter the input end 13 of the drum 12.

The input hopper 15 may include a pre-screening device, if required, to exclude material of excessive size. By way of example, a bar grizzly screen may be provided, to remove tree roots and branches from site clearance material.

In the particular embodiment shown in FIGS. 1 and 2, the main frame 11 is rotatably mounted on a chassis 18 of a pair of endless tracks 19, via a horizontal slew ring 20, so as to provide an easily manoeuvred screening plant, and in which the discharge of material from the drum 12 can be easily adjusted to suit site requirements.

To provide balance to the off-set mass of the single drum 12, a counterweight 21 is mounted on the main frame 11 on the opposite side of the slewing axis to the drum 12. Conveniently, the counterweight is formed wholly or partly by the engine and related drive components which operate the screening plant and propel it when necessary.

Figure 3:
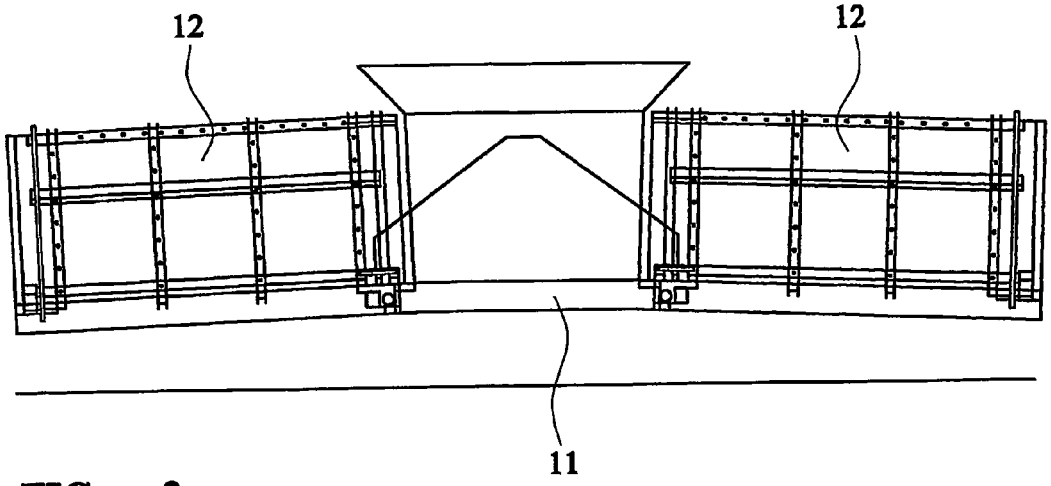
FIG. 3 is a schematic illustration of a tandem trommel drum type of screening plant, to be used as a static installation.
Figure 4:
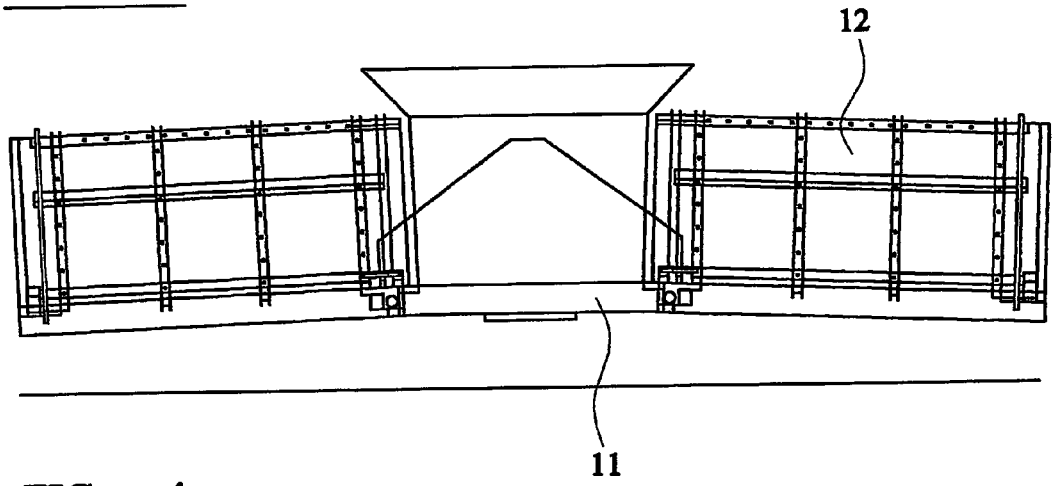
FIG. 4 is a view, similar to FIG. 3, showing the tandem drum arrangement ready to be mounted via a slewing ring on a chassis of a pair of endless tracks.
Figure 5:
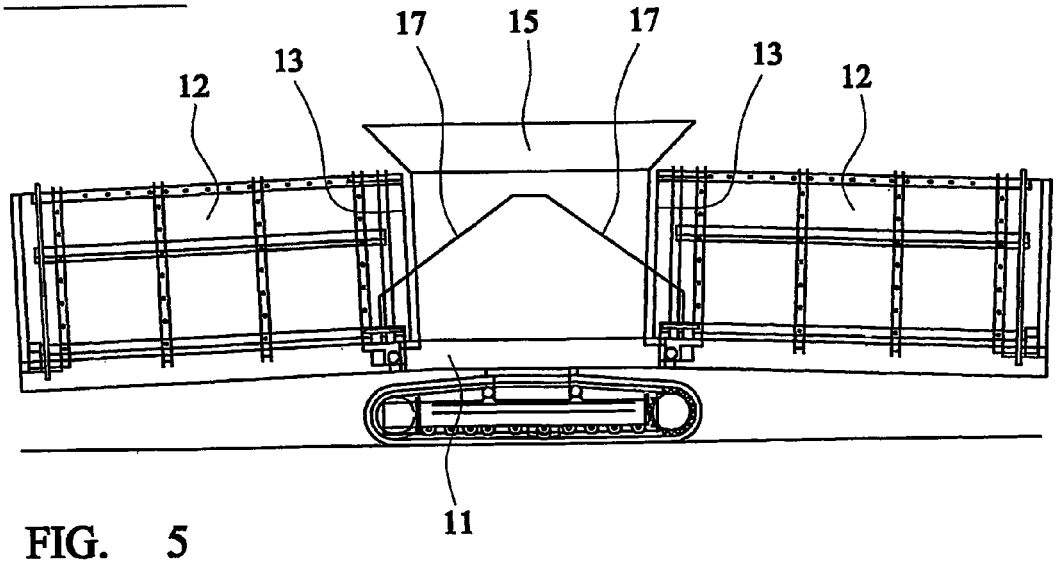
FIG. 5 shows the tandem drum arrangement mounted on the pair of endless tracks.

As an alternative to a single drum type of plant as shown in FIGS. 1 and 2, a tandem arrangement of drums may be provided, as shown in FIGS. 3, 4 and 5. A tandem arrangement of cantilever-mounted drums 12 is provided, mounted on main frame 11, and each having its input end 13 arranged inboard so as to receive bulk material from a respective guide chute 17 and an outboard discharge end. It will be noted that the input ends 13 face each other, and that the two guide chutes 17 effectively form an inverted V-shape, so as to direct the material from the input hopper 15 laterally outwardly into two separate streams of material to be screened by the respective drums 12.

The tandem arrangement of drums 12 may be provided in a static type of screening plant, as shown in FIG. 3. Alternatively, if a self-propelled screening plant is required, the main frame 11 plus the tandem arrangement of drums 12 is again mounted via a horizontal slew ring on a chassis of a pair of endless tracks.

Figure 6:
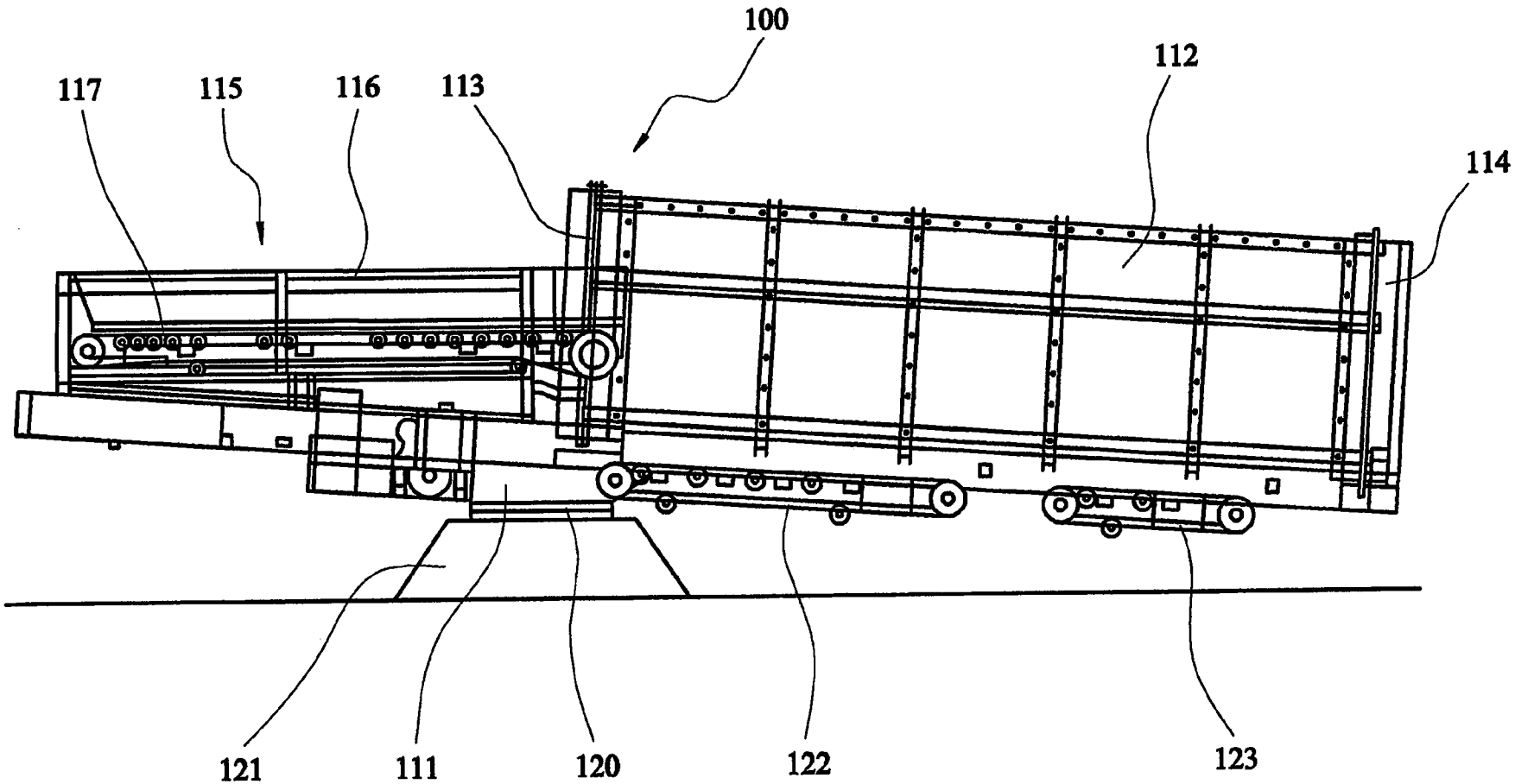
FIG. 6 is a side view of a further embodiment of screening plant according to the invention, in the form of a single trommel drum type of screening plant rotatably mounted on a fixed or static installation via a slew ring.

A further embodiment of single trommel type screening plant is shown in FIG. 6, and which is a static installation, having a fixed support 121, on which screening plant 100 is rotatably mounted via slew ring 120. An input hopper 115 has a receiving mouth 116 to receive a supply of bulk material, and underlying this is an endless conveyor 117 which conveys the bulk material into the input end 113 of drum 112, and which has a lower discharge end 114. A pair of discharge conveyors 122, 123 underlie the drum 112, and are spaced apart along its length, and being intended to receive different size screening fractions from the drum 112.

Figure 7:
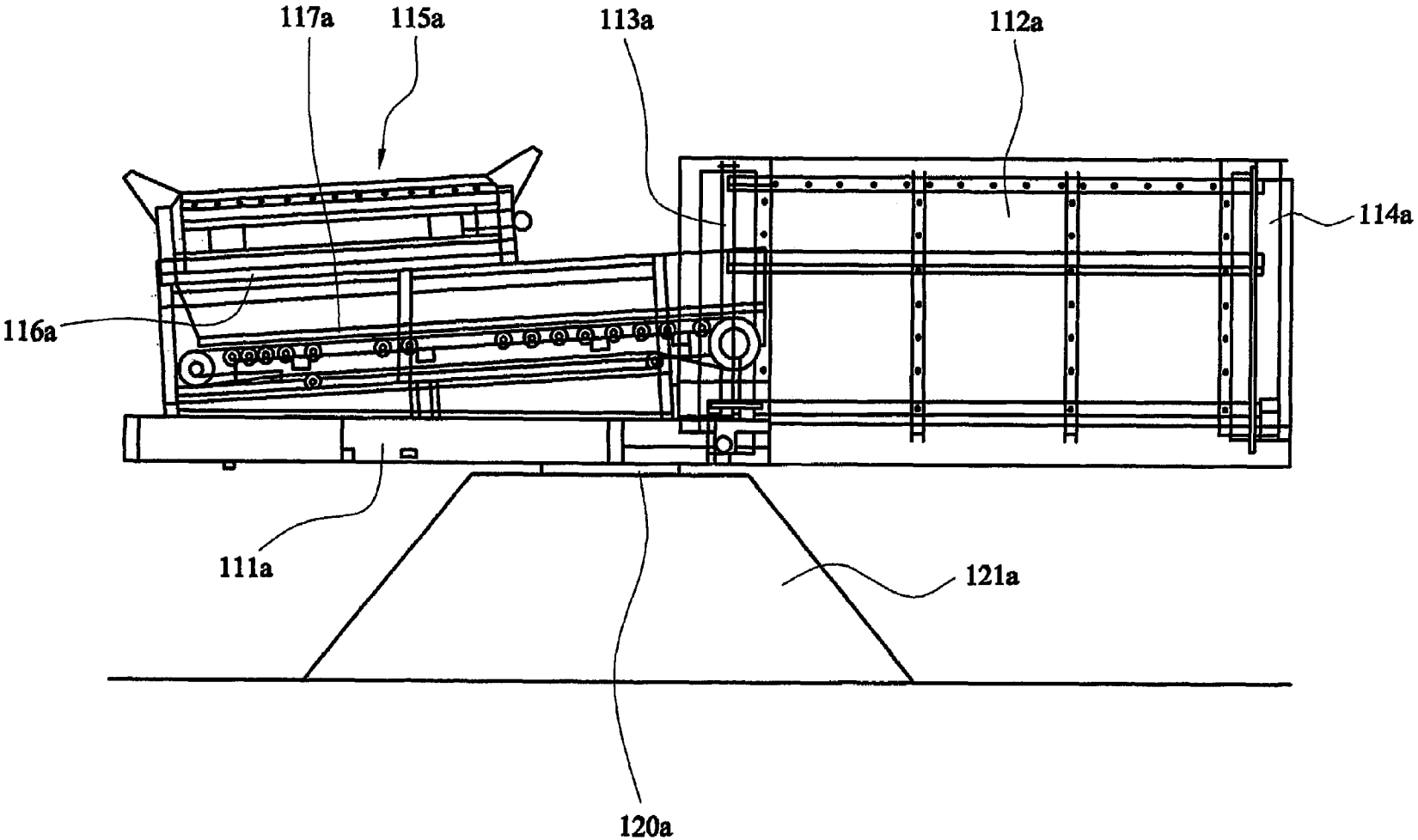
FIG. 7 is a view, similar to FIG. 6, showing a modified arrangement of input feed to the drum.

FIG. 7 shows a generally similar arrangement to that of FIG. 6, and bears the same reference numerals, but with the addition of the letter a. In this embodiment, input hopper 115*a* incorporates a pre-screening device, arranged above receiving mouth 116*a*. Endless conveyor 117*a* feed material into the input end 113*a* of drum 112*a*, and which has a lower discharge end 114*a*. The entire assembly is mounted on fixed support 121*a* in a static installation, via slew ring 120*a*, which rotatably mounts the frame 111*a*.

Figure 8:
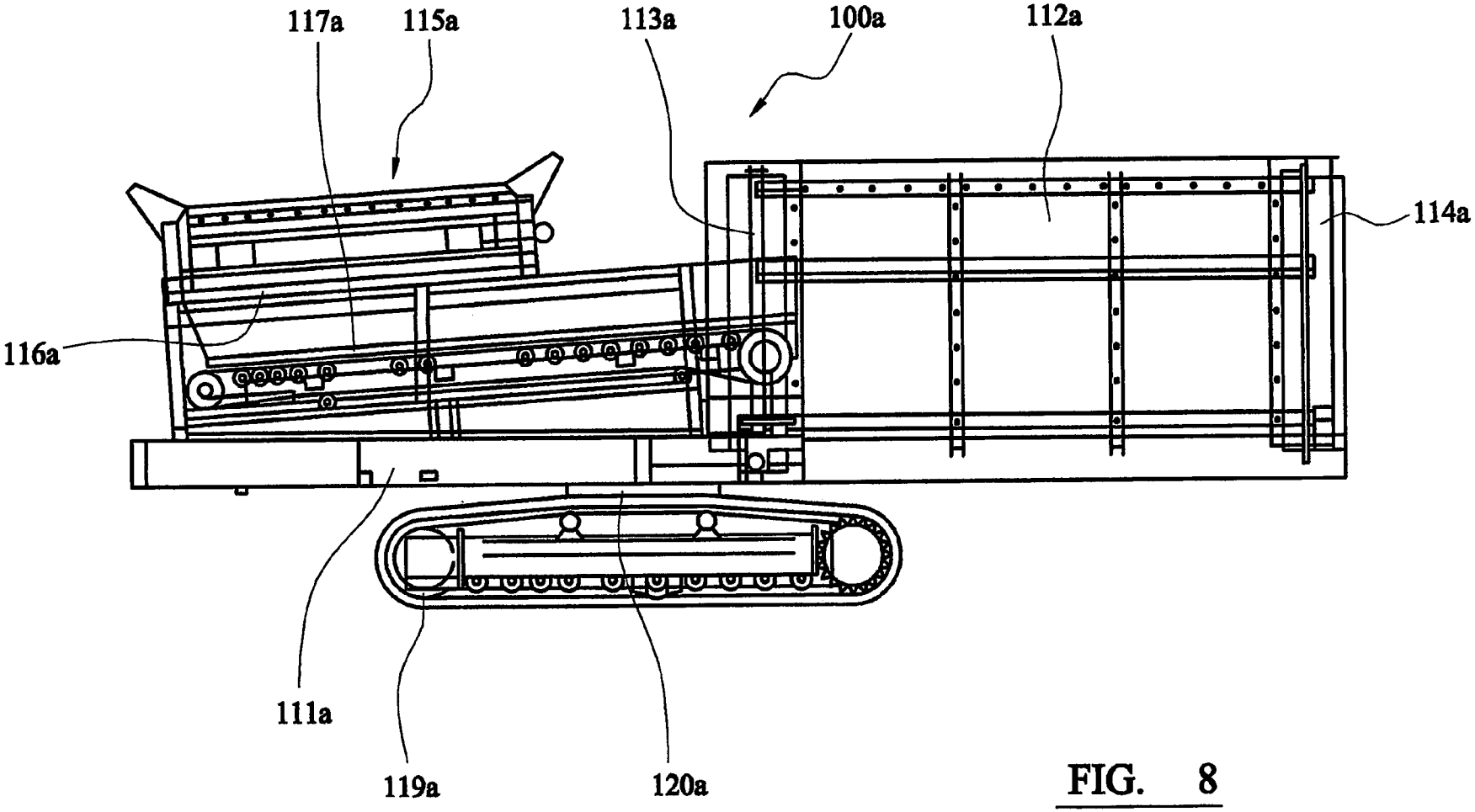
FIG. 8 is a side view of a still further embodiment of single trommel type screening plant, in assembly with an input feed arrangement, and both mounted rotatably on a pair of endless tracks via a slew ring.

FIG. 8 shows a single trommel type of screening plant 100*a*, having trommel drum 112*a*, provided with input end 113*a* and discharge end 114*a*. Input hopper 115*a* incorporates a pre-screening device, and supplies screened bulk material to receiving mouth 116*a*, below which there is arranged endless conveyor 117*a* which feeds the bulk material into the end 113*a* of trommel drum 112*a*.

A support frame 111*a* supports both the input hopper arrangement 115*a* and trommel drum 112*a*, and the frame is rotatably mounted on a chassis of a set of endless tracks 119*a*, via slew ring 120*a*, mounted between the chassis and the track frame.

Figure 9:
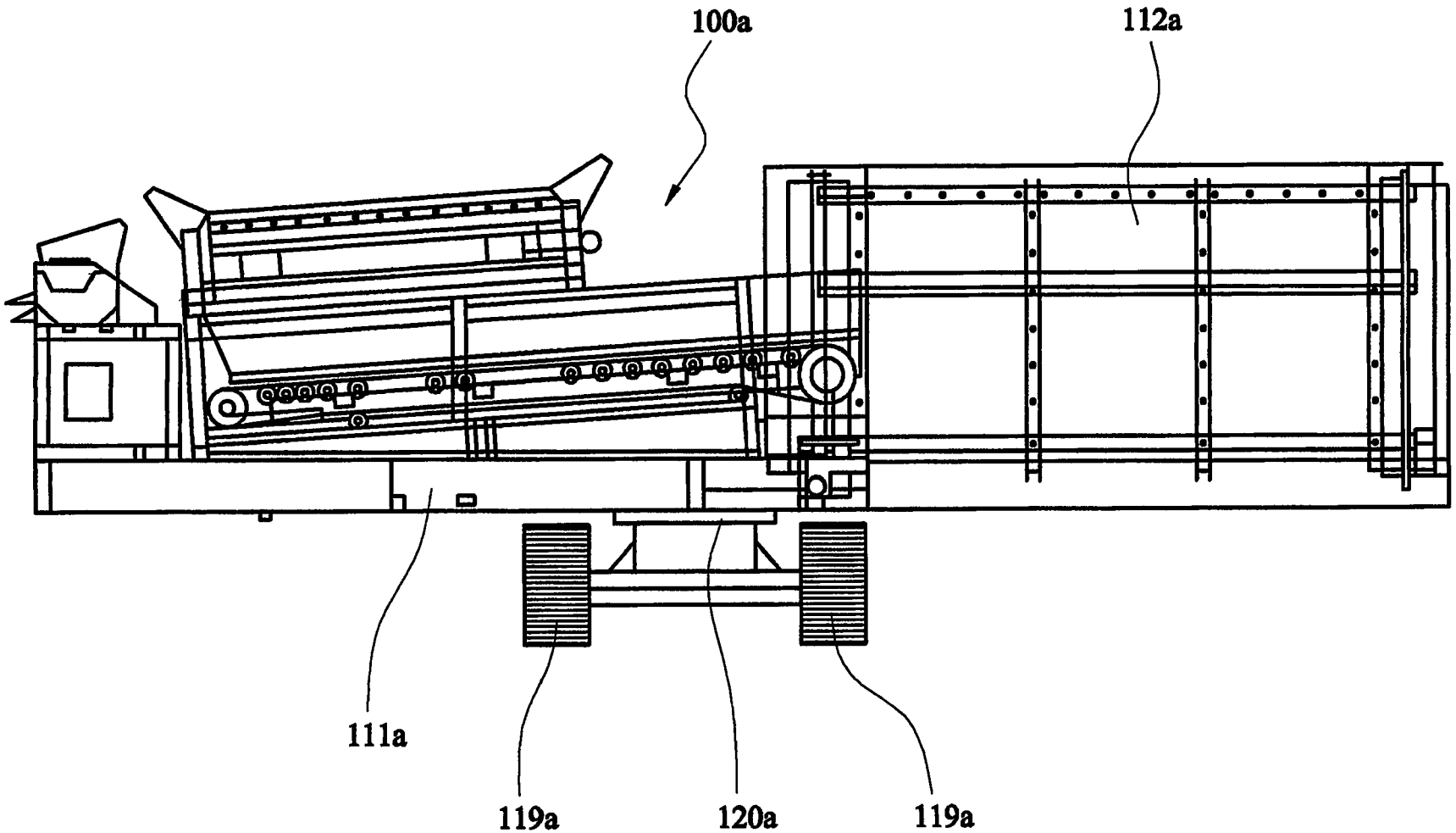
FIG. 9 is a view, similar to FIG. 8, but showing the set of endless support tracks moved through 90° relative to the illustration in FIG. 8.

FIG. 8 shows the drum 112*a* oriented so that its axis extends parallel to the direction of the tracks 119*a*, and FIG. 9 shows angular adjustment of the drum through 90°.

All of the variants of trommel design disclosed herein are cantilever-mounted in the chassis via a robust design of near-vertical slew ring assembly which is rotatably mounted and held captive in a rigid mounting assembly secured to the chassis adjacent to the input end of the trommel.

A common design of mounting assembly and slew ring may be provided, and to which different trommels can be secured having different cross-section; cylindrical or frusto-conical (taper) shape; and varying length.

Figure 15:
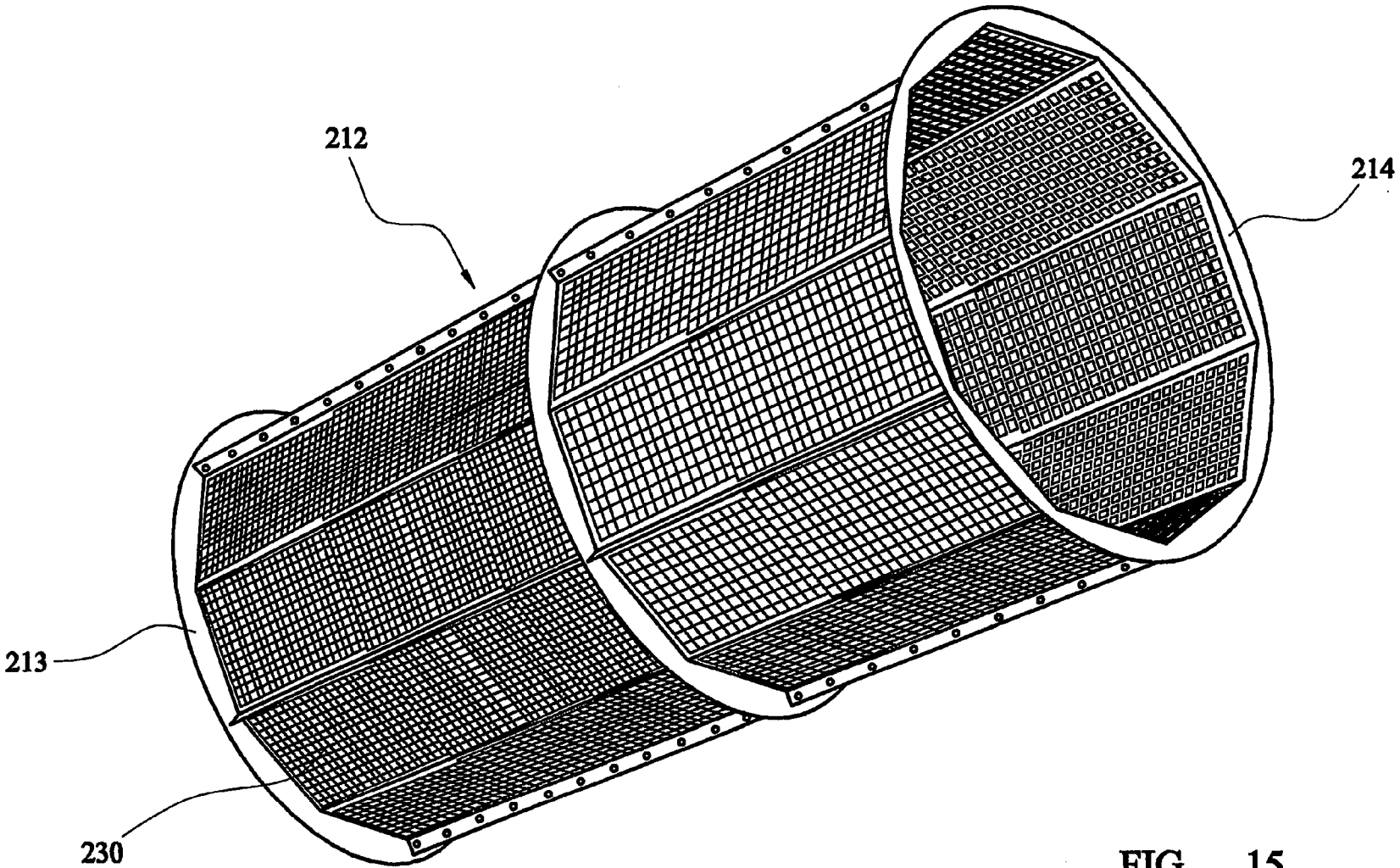
FIG. 15 is a perspective illustration of one example of a non-circular screening drum which may be incorporated in a screening plant according to the invention.

By way of example, FIG. 15 shows an eight-sided trommel drum 212, and tapering towards one end. Existing designs of trommel assemblies are only able to mount trommel drums having a cylindrical shape of constant circular cross-section throughout their lengths, and with specific designs of rotatable mountings for each drum type.

Referring now to FIGS. 10 to 15, there is shown in more detail the manner by which a trommel drum can be mounted in cantilever manner on the main chassis of the plant, via a mounting assembly which comprises a rigid mounting plate secured to the chassis, and on which a near-vertical slewing ring is rotatably mounted so as to be able to carry out two functions. First of all, the slewing ring defines a pivot axis for the entire drum, and receives drive input from a pair of input gears arranged externally of the slewing ring and engageable with a circumferential ring gear provided on the outer surface of the stewing ring. The slewing ring is rotatably mounted in a bearing assembly, provided on the mounting plate, and the mounting assembly also holds the slewing ring in a cantilever mounting, which is able to bear the entire static and dynamic load of the drum, and of material being screened by the drum, in service.

The trommel drum is designated generally by reference 212, and in the example of FIG. 15, is an eight sided drum which tapers towards one end, to promote handling of the material to be screened, and eventual discharge of oversized material from the remote end of the drum i.e. the end remote from the input end which is mounted in cantilever manner, and receives rotary drive input.

Figure 10:
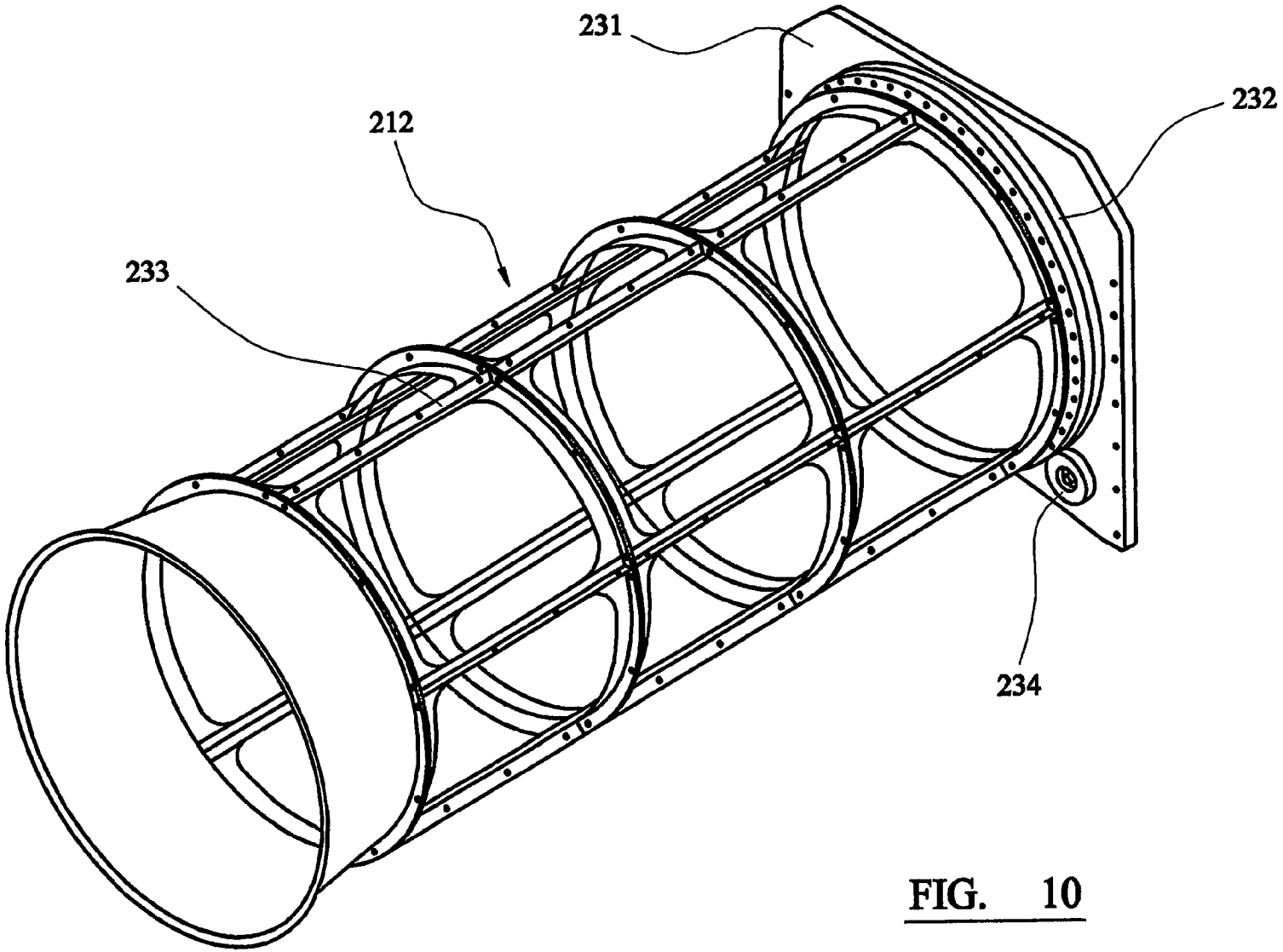
FIG. 10 is a perspective illustration looking obliquely from the discharge end of a trommel drum, with screening apertures omitted for the sake of clarity, and illustrating in more detail how the drum is mounted via its input drive end in a cantilever mounting, including a near-vertical slewing ring.
Figure 11:
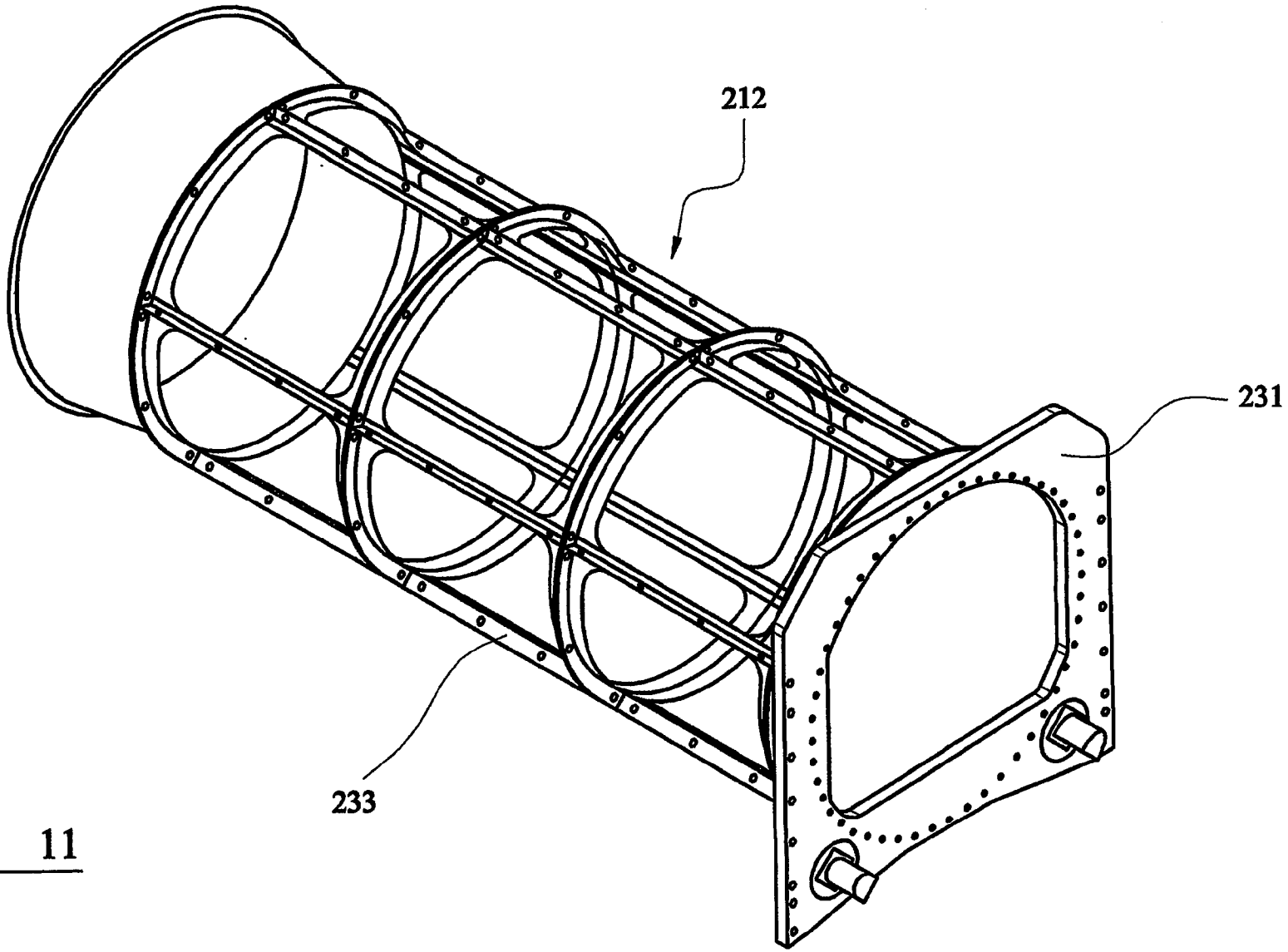
FIG. 11 is a perspective view of the drum shown in FIG. 10, but viewed from the input end.
Figure 12:
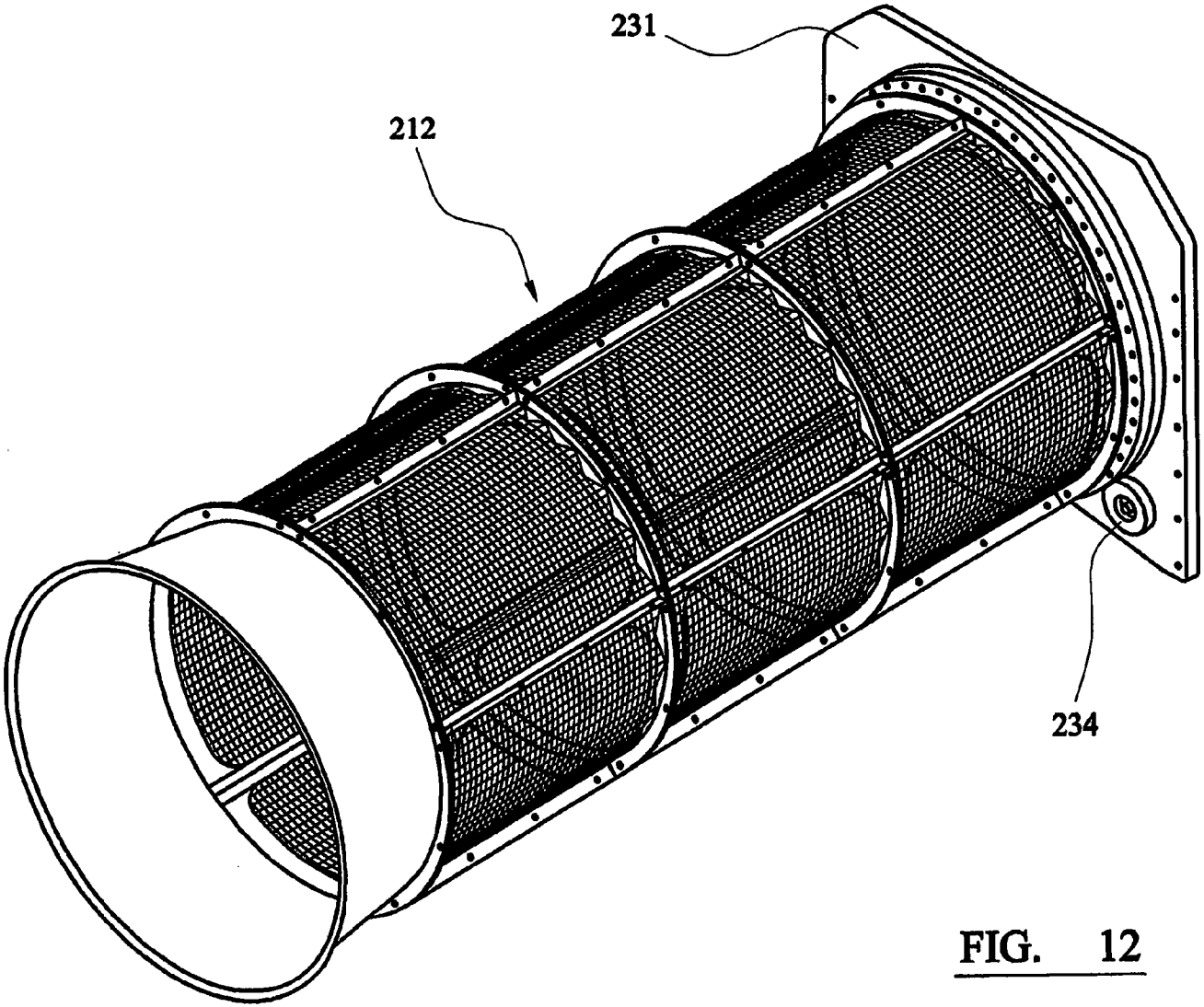
FIG. 12 is a view, similar to FIG. 10, showing the screening apertures provided on the drum.
Figure 13:
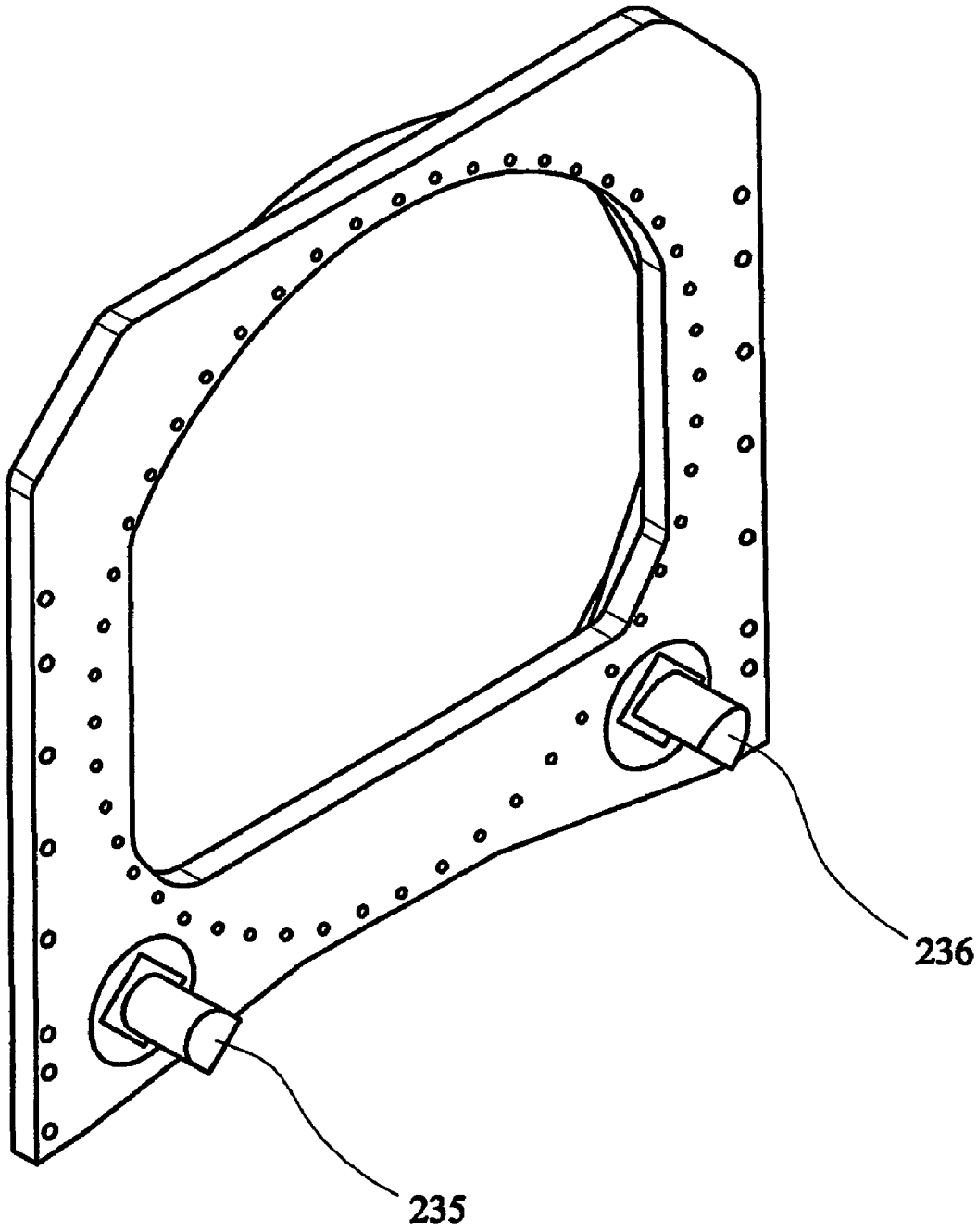
FIG. 13 is a perspective view, viewed in the direction of the drum, and showing an inboard face of a mounting plate on which the slewing ring is rotatably mounted and held in cantilever manner.

The drum 212 therefore has an input end 213 and a discharge end 214, and an octagonal arrangement of screening sides provided with screening apertures 230, as shown. The input end 213 of the drum is mounted in cantilever manner, and also rotatably, in a bearing assembly provided on an outward face of a rigid mounting plate 231 which is mounted rigidly on the chassis or main frame of the screening plant (not shown). A slewing ring 232 is securely fastened to one end of the drum 212, by being bolted or otherwise secured to a supporting framework 233, as shown in FIGS. 10 and 11. The slewing ring 232 is held captive in a bearing assembly, and receives rotary drive input from a pair of circumferentially spaced external input gears 234. The input gears 234 mesh with circumferential drive teeth provided on the outer surface of the slewing ring 232. The input gears 234 are preferably made of self-lubricating synthetic plastics material.

The slewing ring 232 effectively forms an outer race of a bearing assembly, of which a fixed inner race 235 (see FIG. 14) is securely mounted on an outboard face of the mounting plate 231.

Despite the relatively short axial dimensions of the bearing assembly, which rotatably mounts the drum (and also mounts the drum in cantilever manner), the robust design and assembly of the components is such that the dead and live loads generated in service by the rotating drum can be easily borne by the mounting assembly. This is despite the fact that the bearing assembly may have an axial dimension of 120 mm for the slewing ring, and about 100 mm for the inner race, compared with the very substantial axial extent of the drum itself.

The mounting plate 231 and the slewing ring 232 (and the cooperating components of the bearing assembly), can be provided as a common set of components, to which any design of trommel drum can be assembled. It is only necessary for the common slewing ring to be rigidly connected to an input end of a support framework for the particular drum concerned. The trommel drum therefore may be a cylindrical drum, of constant circular cross section throughout its length. However, other cross sectional shapes may be provided, such as the octagonal shape shown in FIG. 15. Also, the cross section may vary continuously from one end to the other, so as to provide a tapering construction, if required, which may facilitate the screening process.

Figure 14:
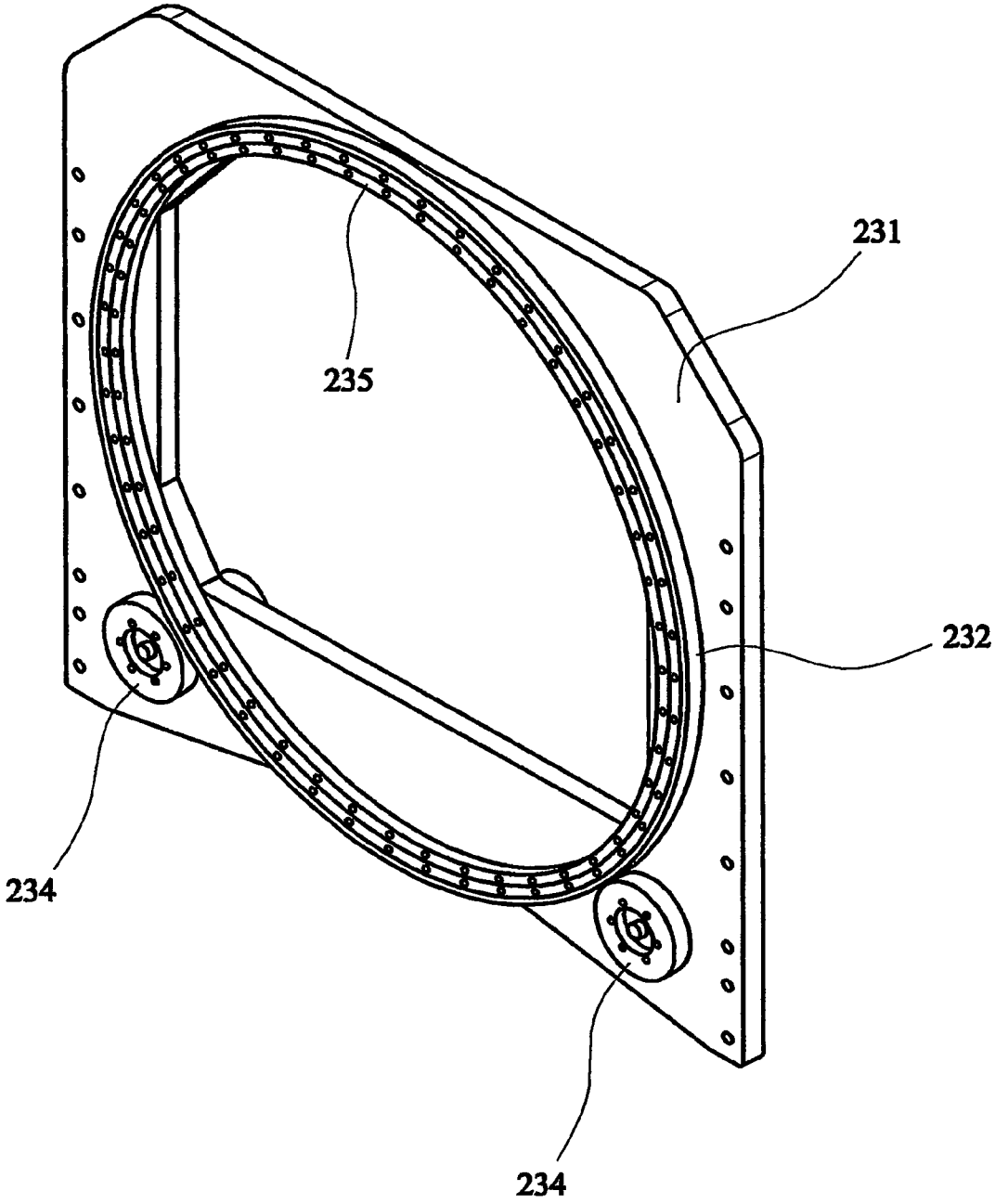
FIG. 14 is a perspective view from the opposite side of the mounting plate.

FIG. 14 shows the input gears 234 which apply drive to rotate the slewing ring 232. FIG. 11 shows the inboard face of the mounting plate 231, and on which are mounted rotary inputs 236 to drive the input gears 234.

Although not shown in the drawings, an external framework may be provided which partly surrounds the trommel drum, with the drum being rotatable therein, and no direct connection with the external framework. This external framework may mount brushes which apply a brushing action to the cylindrical outer surface of the screening sections, so as to facilitate removal of screened material which falls onto the ground below the trommel drum. Oversized material is discharged from the remote discharge ends.

The invention claimed is:

1. A screening plant which comprises:

a main frame;

a trommel drum mounted on the main frame to be rotatable about a rotational axis at a small angle to the horizontal, said drum having an input end for receiving a bulk supply of raw material and an opposite discharge end, at a lower end than the input end;

screening apertures provided in the wall of the drum;

drive means coupled with the drum and operative to rotate the drum while screening takes place;

an input hopper mounted on the main frame and arranged to supply bulk material to the input end of the drum, said hopper comprising:

an upper receiving mouth; and an inclined guide chute arranged below the mouth to receive the bulk material and to guide the material laterally so as to enter the input end of the drum; characterized by:

a slew ring upon which the main frame is rotatably mounted so as to allow the trommel drum and main frame to rotate so as to adjust the position of the discharge end of the drum; and means to mount an input end of the trommel drum so as to mount the trommel drum in a cantilever manner at the main frame.

2. The screening plant according to claim 1, in which the input hopper includes a pre-screening device.

3. The screening plant according to claim 1, in which the main frame is rotatably mounted on a chassis of a pair of endless tracks via a slew ring, so as to provide an easily maneuverable screening plant.

4. The screening plant according to claim 3, in which a counterweight is mounted on the main frame, on the opposite side of the slewing axis to the drum.

5. The screening plant according to claim 4, in which the counterweight is formed wholly or partly by an engine and related drive components of the plant.

6. The screening plant according to claim 1, in which a tandem arrangement of drums is mounted on the main frame, each having an inboard input end arranged to receive bulk material from a respective inclined guide chute in the input hopper, and an outboard discharge end.

7. The screening plant according to claim 6, in which the tandem arrangement of drums is provided in a static type of screening plant.

8. The screening plant according to claim 6, in which the main frame plus the tandem arrangement of drums is mounted on a chassis of a pair of endless tracks via a slew ring.

9. The screening plant according to claim 1, in which a bearing assembly rotatably mounts an input end of the drum, and also forms a cantilever mounting assembly which mounts the drum on a mounting plate secured to the main frame or chassis of the plant.

10. A screening plant which comprises:

a main frame;

a tandem arrangement of trommel drums mounted on the main frame and each being rotatable about a rotational axis at a small angle to the horizontal, and having an input end for receiving a bulk supply of raw material and an opposite discharge end at a lower end than the input end;

screening apertures provided in the wall of each drum;

drive means coupled with the drums;

and an input hopper mounted on the main frame and arranged to supply bulk material to the input end of each of the drums;

characterized by:

a slew ring upon which the main frame is rotatably mounted so as to allow the trommel drum and main frame to rotate so as to adjust the position of the discharge end of the drum; and means to mount an input end of the trommel drum so as to mount the trommel drum in a cantilever manner at the main frame.

11. The screening plant according to claim 10, including a fixed support on which the plant is rotatably mounted via the slew ring.

12. The screening plant according to claim 10, in which the drum is a long drum having underlying discharge conveyors spaced apart lengthwise of the drum and arranged to receive different size screened fractions from the drum.

13. The screening plant according to claim 10, in which the input hopper has a preliminary screening device arranged above the receiving mouth.

14. A screening plant which comprises:

a main frame;

a trommel drum mounted on the main frame to be rotatable about a rotational axis at a small angle to the horizontal, said drum having an input end for receiving a bulk supply of raw material and an opposite discharge end at a lower end than the input end;

screening apertures provided in the wall of the drum;

drive means coupled with the drum;

a screen deck mounted on the main frame opposite the trommel drum and arranged to supply bulk material to the input end of the drum;

characterized by:

a slew ring upon which the main frame is rotatably mounted so as to allow the trommel drum and main frame to rotate so as to adjust the position of the discharge end of the drum; and means to mount an input end of the trommel drum so as to mount the trommel drum in a cantilever manner at the main frame.

15. A screening plant, which comprises:

a main frame;

a trommel drum mounted on the main frame to be rotatable about a rotational axis at a small angle to the horizontal, said drum having an input end for receiving a bulk supply of raw material and an opposite discharge end, at a lower end than the input end;

screening apertures provided in the wall of the drum;

drive means coupled with the drum and operative to rotate the drum while screening takes place;

an input hopper mounted on the main frame and arranged to supply bulk material to the input end of the drum, said hopper having an upper receiving mouth, and a conveyor arranged below the mouth to receive the bulk material and to feed the material laterally so as to enter the input end of the drum;

characterized by:

a set of endless tracks rotatably supporting the frame via a slew ring; and means to mount an input end of the trommel drum so as to mount the trommel drum in a cantilever manner at the main frame.

16. A screening plant which comprises:

a main frame;

a trommel drum mounted on the main frame to be rotatable about a rotational axis at a small angle to the horizontal, said drum having an input end for receiving a bulk supply of raw material and an opposite discharge end, at a lower end than the input end;

screening apertures provided in the wall of the drum;

drive means coupled with the drum and operative to rotate the drum while screening takes place;

an input arrangement for receiving a supply of material to be screened, and for feeding or guiding the material to the input end of the drum;

characterized by:

a cantilever-type rotatable mounting assembly, which rotatably mounts the drum on a mounting plate which is secured to the main frame or chassis of the screening plant; and a slew ring upon which the main frame is rotatably mounted so as to allow the trommel drum and main frame to rotate so as to adjust the position of the discharge end of the drum.

17. The screening plant according to claim 16, in which the cantilever type mounting assembly includes a near vertical slewing ring forming part of a rotatable bearing assembly, mounted on the mounting plate.

* * * * *